US010388214B2

(12) United States Patent
Na

(10) Patent No.: US 10,388,214 B2
(45) **Date of Patent: *Aug. 20, 2019**

(54) ORGANIC LIGHT EMITTING DISPLAY AND DRIVING METHOD OF THE SAME

(71) Applicant: SAMSUNG DISPLAY CO., LTD., Yongin, Gyeonggi-Do (KR)

(72) Inventor: Ji Su Na, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 211 days.

This patent is subject to a terminal disclaimer.

(21) Appl. No.: 14/685,470

(22) Filed: Apr. 13, 2015

(65) Prior Publication Data

US 2016/0155379 A1 Jun. 2, 2016

(30) Foreign Application Priority Data

Dec. 2, 2014 (KR) ..... 10-2014-0170328

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0216* (2013.01); *G09G 2310/0218* (2013.01); *G09G 2310/0297* (2013.01); *G09G 2320/045* (2013.01)

(58) Field of Classification Search
None
See application file for complete search history.

(56) References Cited

U.S. PATENT DOCUMENTS

2007/0063958 A1* 3/2007 Toyozawa ..... G09G 3/20 345/98
2012/0026143 A1 2/2012 Jang
2012/0306840 A1 12/2012 Han
(Continued)

FOREIGN PATENT DOCUMENTS

CN 103325810 A 9/2013
KR 10-2011-0063021 A 6/2011
(Continued)

*Primary Examiner* — Joseph R Haley
*Assistant Examiner* — Emily J Frank
(74) *Attorney, Agent, or Firm* — Lewis Roca Rothgerber Christie LLP

(57) ABSTRACT

An organic light-emitting display device includes: a plurality of pixels arranged in a matrix, wherein each of the pixels includes: an organic light emitting element; a first transistor including a gate electrode coupled to a scan line, a first electrode coupled to a data line, and a second electrode coupled to a first node, a second transistor configured to drive the organic light emitting element according to a data voltage provided through the first transistor; a third transistor including a first electrode coupled to the first node and a second electrode coupled to a second node; a first capacitor between the first node and a third node configured to have an initialization voltage applied; and a second capacitor between a fourth node coupled to a gate electrode of the second transistor and the second node.

19 Claims, 13 Drawing Sheets

(56) References Cited

U.S. PATENT DOCUMENTS

| | | | | |
|---|---|---|---|---|
| 2014/0062988 | A1* | 3/2014 | Lee | G09G 3/3233 345/212 |
| 2014/0085284 | A1* | 3/2014 | Sun | G09G 3/3233 345/211 |
| 2014/0176616 | A1* | 6/2014 | Gu | G09G 3/3266 345/690 |
| 2014/0347401 | A1 | 11/2014 | Hwang et al. | |
| 2016/0155387 | A1* | 6/2016 | Kim | G09G 3/3291 345/76 |

FOREIGN PATENT DOCUMENTS

| | | | |
|---|---|---|---|
| KR | 10-2011-0139005 | A | 12/2011 |
| KR | 10-2012-0075828 | A | 7/2012 |
| KR | 10-2013-0098613 | A | 9/2013 |
| KR | 10-2014-0053601 | A | 5/2014 |
| WO | WO 2012/053462 | A1 | 4/2012 |

* cited by examiner

ORGANIC LIGHT EMITTING DISPLAY AND DRIVING METHOD OF THE SAME

CROSS-REFERENCE TO RELATED APPLICATION

This application claims priority to and the benefit of Korean Patent Application No. 10-2014-0170328 filed on Dec. 2, 2014, in the Korean Intellectual Property Office, the contents of which in its entirety are herein incorporated by reference.

FIELD

The present invention relates to an organic light emitting display device and a driving method of the same.

BACKGROUND

An organic light emitting display, which has attracted attention as a next-generation display device includes a self-luminous element which emits light with the characteristics of a relatively rapid response speed and relatively high emission efficiency, relatively high luminance, and a relatively large viewing angle. Each pixel of the organic light emitting display has an organic light emitting diode (hereinafter, referred to as an "OLED") which is a self-light emitting element. In addition, a data line for applying a data signal having light emission information of the pixel and a scan line for applying a scan signal so that the data signal may be sequentially applied to the pixel are coupled to each pixel of the organic light emitting display. In the organic light emitting display, the pixels coupled to the same data line are coupled with different scan lines and the pixels coupled to the same scan line are coupled to different data lines. Accordingly, in the case of increasing the number of pixels in order to increase a resolution of a flat panel display, the number of data lines or scan lines is proportionally increased, and as a result, the number of circuits included in a data driver which generates and applies the data signals may increase due to a corresponding increase in the number of data lines. The increase in data driver circuit elements and data lines may result in increased manufacturing costs.

Reducing the number of circuits included in the data driver by demultiplexing the data signals in which many signals are combined in a demultiplexer to sequentially apply the demultiplexed data signals to a plurality of data lines may help to reduce some manufacturing costs. However, as the resolution is increased, one horizontal time may be reduced, and as a result, a time where the scan signals are applied in one horizontal time may be reduced. For example, in the case of providing a compensation circuit which compensates for a threshold voltage for a period when the scan signals are applied so as to prevent deterioration of image quality in each pixel, as the time when the scan signals are applied is reduced, the threshold voltage may not be sufficiently compensated, and as a result, a Mura phenomenon may occur.

The above information discussed in this Background section is only for enhancement of understanding of the background of the described technology and therefore it may contain information that does not constitute prior art that is already known to a person having ordinary skill in the art.

SUMMARY

Aspects of embodiments of the present may include an organic light emitting diode having characteristics of sufficiently ensuring a compensating time and a demultiplexing time of a threshold voltage.

Aspects of embodiments of the present invention may include a driving method of the organic light emitting display having characteristics of sufficiently ensuring a compensating time and a demultiplexing time of a threshold voltage.

According to aspects of example embodiments of the present invention, an organic light emitting display includes: a plurality of pixels arranged in a matrix, wherein each of the pixels includes: an organic light emitting element; a first transistor including a gate electrode coupled to a scan line, a first electrode coupled to a data line, and a second electrode coupled to a first node, a second transistor configured to drive the organic light emitting element according to a data voltage provided through the first transistor; a third transistor including a first electrode coupled to the first node and a second electrode coupled to a second node; a first capacitor between the first node and a third node configured to have an initialization voltage applied; a second capacitor between a fourth node coupled to a gate electrode of the second transistor and the second node; a fourth transistor including a first electrode coupled to the second node and a second electrode coupled to a fifth node coupled to the second electrode of the second transistor; a fifth transistor including a first electrode coupled to the fourth node and a second electrode coupled to a sixth node coupled to an electrode of the second transistor; a sixth transistor including a first electrode coupled to the third node and a second electrode coupled to an anode electrode of the organic light emitting element; and a seventh transistor including a first electrode coupled to the sixth node and a second electrode coupled to the anode electrode of the organic light emitting element.

Gate electrodes of the fourth transistor, the fifth transistor, and the sixth transistor may be coupled to a same control signal line.

Gate electrodes of the fourth transistor, the fifth transistor, and the sixth transistor may be coupled to different control signal lines.

Gate electrodes of the fourth transistor, the fifth transistor, and the sixth transistor may be coupled to a first control signal line, and a gate electrode of the third transistor may be coupled to a second control signal line different from the first control signal line.

The plurality of pixels may be arranged in a plurality of pixel row groups including pixel rows of a same number, and the third transistor of the pixels of a first pixel row group of the pixel row groups may be coupled with a scan line coupled with a second pixel row group of the pixel row groups adjacent the first pixel row group.

Each of the pixel row groups may include 8 pixel rows, and the gate electrode of the third transistor of pixels included in a pixel row group of the pixel row groups including k to k+7-th scan lines may be coupled with a k+12-th scan line, wherein k is a natural number greater than 1.

The organic light emitting display may be configured to simultaneously compensate for a threshold voltage in the pixels included in the plurality of pixel row groups.

The organic light emitting display may be configured to sequentially apply a scan signal to the plurality of pixel row groups.

According to aspects of example embodiments of the present invention, an organic light emitting display includes: a plurality of pixels arranged in matrix including a plurality of pixel row groups including pixel rows of a same number; a scan driver configured to sequentially apply a scan signal to the plurality of pixels; a data driver configured to generate a data signal provided to the plurality of pixels; and a data distributing unit configured to demultiplex the data signal and to transfer the demuliplexed data signal to the plurality of pixels, wherein the organic light emitting display may be configured to simultaneously compensate for a threshold voltage of the pixels included in each pixel row group, which are configured to charge the data signal applied before the compensation of the threshold voltage in a first capacitor, and the organic light emitting display is configured to transfer the data signal charged in the first capacitor to a gate terminal of a driving transistor after the compensation of the threshold voltage.

The pixels in the each pixel row group may further include control transistors that control coupling of the first capacitor and the gate terminal of the driving transistor.

The organic light emitting display may further include: a second capacitor coupled between the control transistor and the gate terminal of the driving transistor.

A gate electrode of each control transistor of the pixels of a first pixel row group is coupled with a scan line coupled with a second pixel row group adjacent the first pixel row group.

Each pixel row group may include 8 pixel rows, and a gate electrode of each control transistor of pixels of a pixel row group including k to k+7-th scan lines may be coupled with a k+12-th scan line, wherein k is a natural number greater than 1.

According to aspects of example embodiments of the present invention, in a driving method of an organic light emitting display, the organic light emitting display includes a plurality of pixels arranged in matrix including a plurality of pixel row groups including pixel rows of a same number to be driven for each pixel row group and each pixel includes an organic light emitting element and a driving transistor driving the organic light emitting element, the method including: demulplexing and inputting a data signal in pixels of a first pixel row group; providing an initialization voltage to the pixels of the first pixel row group; compensating a threshold voltage of driving transistors of the pixels of the first pixel row group; transferring the data signal to gate terminals of the driving transistors; and emitting an organic light emitting element in response to the data signal.

A second pixel row group adjacent the first pixel row group may sequentially receive the data signal from the first pixel row group.

The method may further include simultaneously compensating the threshold voltage of the driving transistors of the pixels included in the first pixel row group.

Each pixel may further include a first capacitor configured to be charged with the data signal and a control transistor controlling connection of the first capacitor and the gate terminal of the driving transistor.

The organic light emitting display may further include a second capacitor coupled between the control transistor and the gate terminal of the driving transistor.

A gate electrode of each of the control transistors of pixels of the first pixel row group may be coupled to a scan line coupled to a second pixel row group adjacent the first pixel row group. Each pixel row group may include 8 pixel rows, and a gate electrode of control transistors of pixels included in a pixel row group including k to k+7-th scan lines may be coupled to a k+12-th scan line, wherein k is a natural number greater than 1.

Aspects of embodiments of the present invention are not limited to the aforementioned characteristics, and other characteristics, which are not mentioned above, will be apparent to those skilled in the art from the following description.

Additional details of aspects of embodiments of the present invention are included in this specification and drawings.

According to aspects of embodiments of the present invention, it may be possible to sufficiently ensure a compensating time and a demultiplexing time of a threshold voltage to improve image quality of the organic light emitting display.

BRIEF DESCRIPTION OF THE DRAWINGS

The above and other features and aspects of the present invention will become more apparent by describing in detail embodiments thereof with reference to the attached drawings in which.

DETAILED DESCRIPTION

Figure 1:
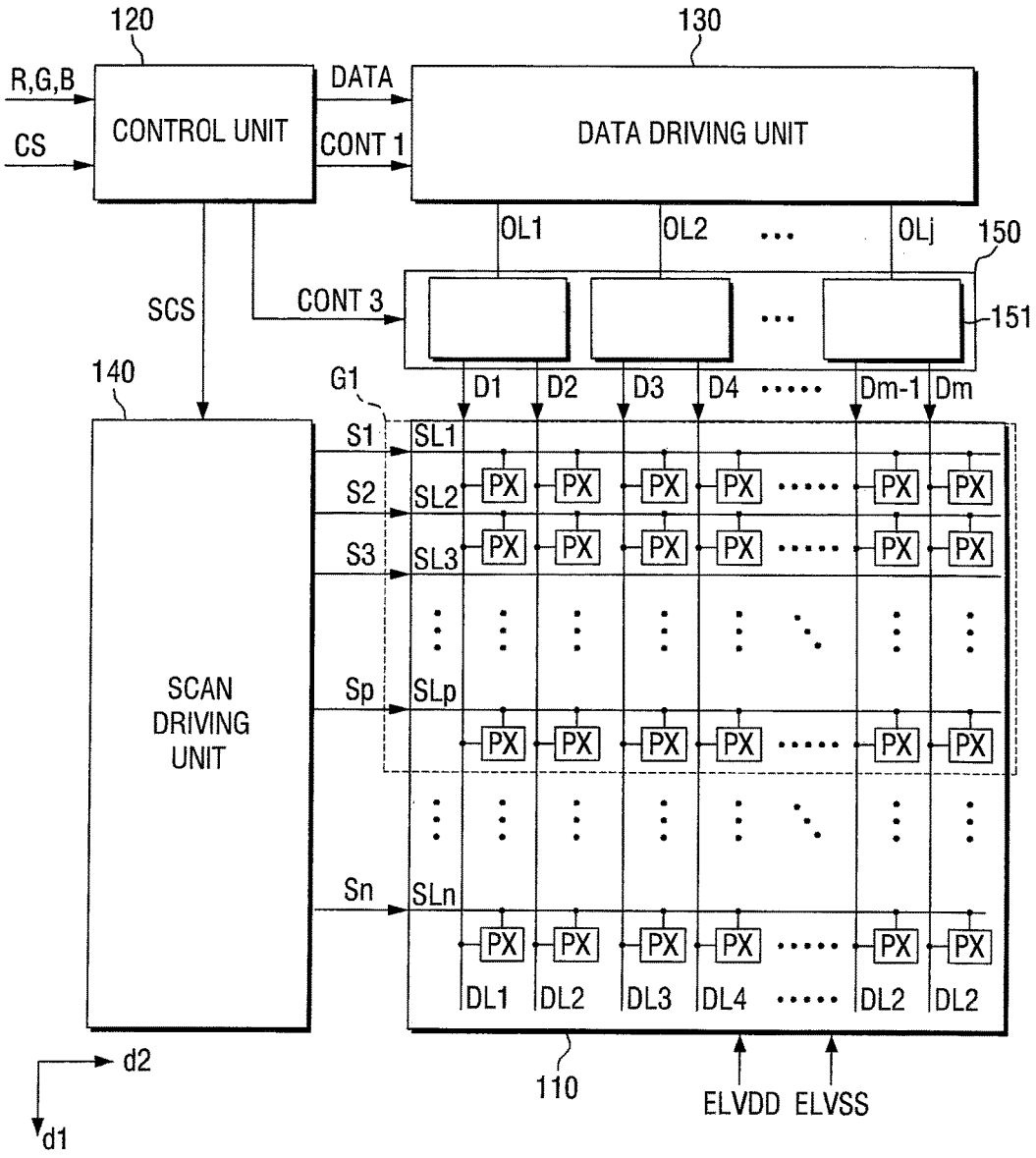
FIG. 1 is a block diagram of an organic light emitting display according to an embodiment of the present invention.

Aspects and features of the present invention and methods of accomplishing the same may be understood more readily by reference to the following detailed description of some embodiments and the accompanying drawings. The present invention may, however, be embodied in many different forms and should not be construed as being limited to the embodiments set forth herein. Rather, these embodiments are provided so that this disclosure will be more thorough and more complete and will fully convey the concept of the invention to those skilled in the art, and the present invention will only be defined by the appended claims, and their equivalents. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to", or "coupled to" another element or layer, it can be directly on, connected, or coupled to the other element or layer or intervening elements or layers may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are included to refer to targets in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, embodiments of the present invention will be described with reference to the accompanying drawings.

Figure 2:
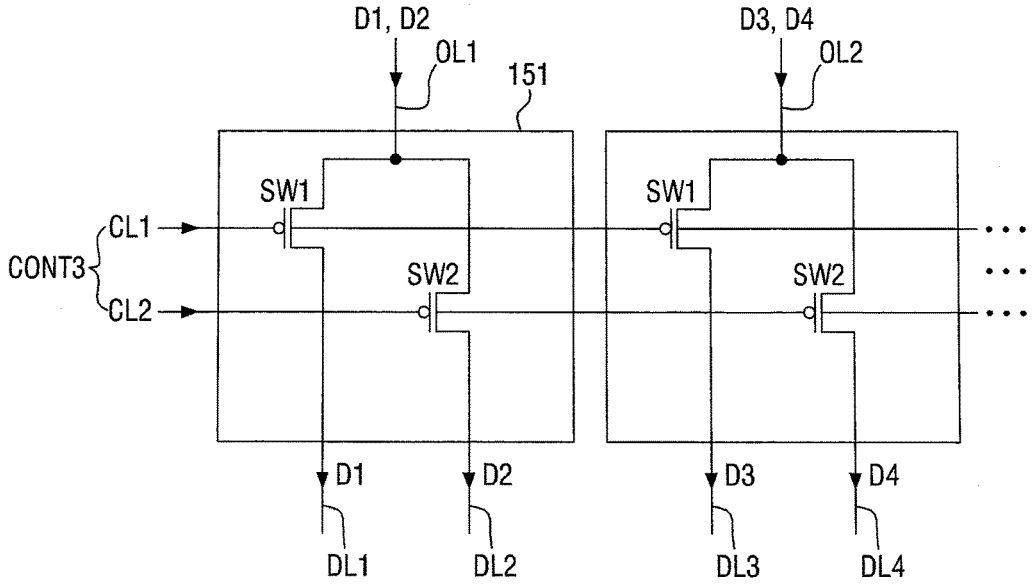
FIG. 2 is a block diagram of a data distributing unit according to the embodiment of the present invention.
Figure 3:
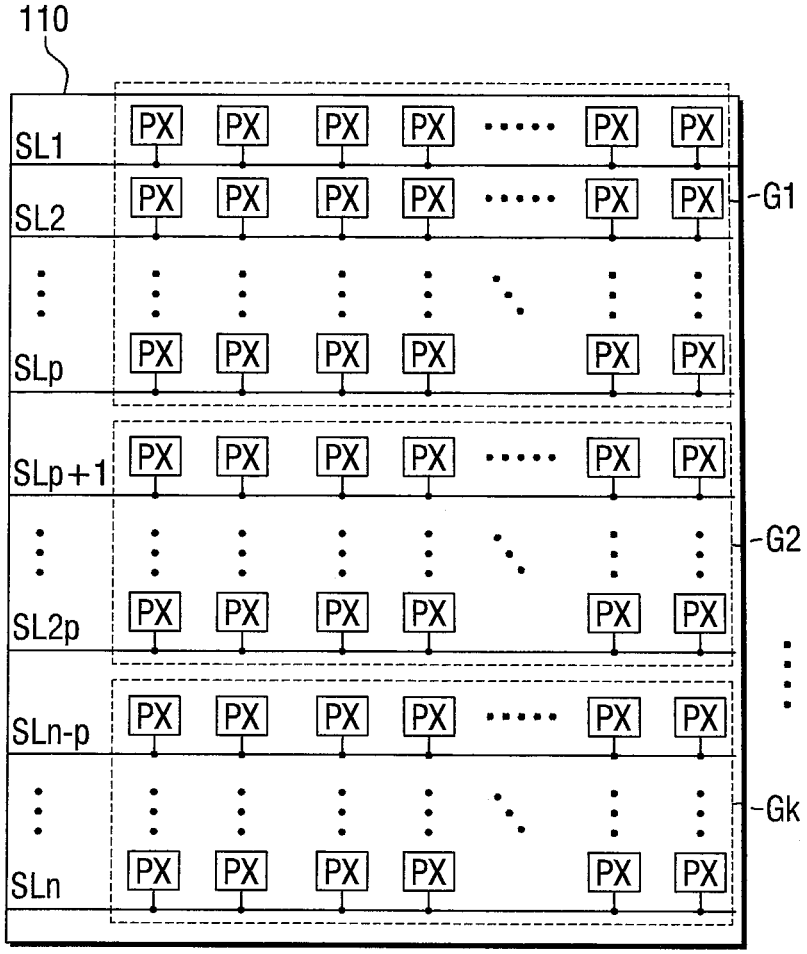
FIG. 3 is a block diagram of a display unit according to the embodiment of the present invention.

FIG. 1 is a block diagram of an organic light emitting display according to an embodiment of the present invention, FIG. 2 is a block diagram of a data distributing unit according to the embodiment of the present invention, and FIG. 3 is a block diagram of a display unit according to the embodiment of the present invention.

Referring to FIGS. 1 to 3, an organic light emitting display 10 includes a display unit 110, a control unit 120, a data driver 130, a scan driver 140, and a data distributing unit 150.

The display unit 110 may be an area in which an image is displayed. The display unit 110 may include a plurality of scan lines SL1, SL2, . . . , SLn, a plurality of data lines DL1, DL2, . . . , DLm crossing the plurality of scan lines SL1, SL2, . . . , SLn, and a plurality of pixels PXs coupled one of the plurality of scan lines SL1, SL2, . . . , SLn and one of the plurality of data lines DL1, DL2, . . . , DLm. Here, n and m are different natural numbers. The plurality of data lines DL1, DL2, . . . , DLm may cross the plurality of scan lines SL1, SL2, . . . , SLn, respectively. That is, the plurality of data lines DL1, DL2, . . . , DLm may extend along a first direction d1 and the plurality of scan lines SL1, SL2, . . . , SLn may extend along a second direction d2 crossing the first direction d1. Here, the first direction d1 may be a column direction and the second direction d2 may be a row direction. The plurality of scan lines SL1, SL2, . . . , SLn may include first to n-th scan lines SL1, SL2, . . . , SLn sequentially arranged in the first direction d1. The plurality of data lines DL1, DL2, . . . , DLm may include first to n-th data lines DL1, DL2, . . . , DLm sequentially arranged in the second direction d2.

The plurality of pixels PXs may be arranged in a matrix form. Each of the plurality of pixels PXs may be coupled with one of the plurality of scan lines SL1, SL2, . . . , SLn and one of the plurality of data lines DL1, DL2, . . . , DLm. Each of the plurality of pixels PXs may receive data signals D1, D2, . . . , Dm applied to the data lines DL1, DL2, . . . , DLm coupled to correspond to scan signals S1, S2, . . . , Sn provided from the coupled scan lines SL1, SL2, . . . , SLn. That is, the scan signals S1, S2, . . . , Sn applied to each pixel PX may be provided to the scan lines SL1, SL2, . . . , SLn, and the data signals D1, D2, . . . , Dm may be provided to the data lines DL1, DL2, . . . , DLm. Each pixel PX may receive a first power voltage ELVDD through a first power line and receive a second power voltage ELVSS through a second power line. Further, each pixel PX is coupled to a light emission control line, a first control line, and a second control line to control light emission. This will be described below in more detail.

The control unit 120 may receive a control signal CS and image signals R, G, and B from an external system. Here, the image signals R, G, and B store luminance information of the plurality of pixels PXs. The luminance may have a number (e.g., a predetermined number), for example, 1024, 256, or 64 grays. The control signal CS may include a vertical synchronization signal Vsync, a horizontal synchronization signal Hsync, a data enable signal DE, and a clock signal CLK. The control unit 120 may generate first to third driving control signals CONT1 to CONT3 and image data DATA according to the image signals R, G, and B and the control signal CS. The control unit 120 may generate the image data DATA by dividing the image signals R, G, and B by a frame unit according to the vertical synchronization signal Vsync and dividing the image signals R, G, and B by a scan line unit according to the horizontal synchronization signal Hsync. Here, the control unit 120 may compensate for the generated image data DATA. That is, the control unit 120 may sense deterioration information in each pixel PX to compensate for the image data DATA so that a luminance deviation is not generated, but it is just an example, and the data compensation performed in the control unit 120 is not limited to those described above. The control unit 120 may output the image data DATA to the data driver 130 together with the first driving control signal CONT1. The control unit 120 may transfer the second driving control signal CONT2 to the scan driver 140 and transfer the third driving control signal CONT3 to the data distributing unit 150.

The scan driver 140 is coupled to the plurality of scan lines of the display unit 110 and may generate the plurality of scan signals S1, S2, . . . , Sn according to the second driving control signal CONT2. The scan driver 140 may sequentially apply the plurality of scan signals S1, S2, . . . , Sn of the gate-on voltages to the plurality of scan lines.

The data driver 130 is coupled to the plurality of data lines of the display unit 110, and may sample and hold the image data DATA input according to the first driving control signal CONT1 and change the image data DATA to an analog voltage to generate the plurality of data signals D1, D2, . . . , Dm. The data driver 130 may output the plurality of data signals D1, D2, . . . , Dm to a plurality of output lines OL1, OL2, . . . , OLj. Each of the plurality of output lines OL1, OL2, . . . , OLj may be coupled to one of a plurality of demultiplexers 151 included in the data distributing unit 150. That is, the plurality of data signals D1, D2, . . . , Dm generated in the data driver 130 may be transferred to the plurality of data lines DL1, DL2, DLm through the data distributing unit 150, respectively.

The data distributing unit 150 may include the plurality of demultiplexers 151. Each demultiplexer 151 may be coupled with one of the plurality of output lines OL1, OL2, . . . , OLj. Each demultiplexer 151 may be coupled with at least two data lines which are sequentially arranged among the plurality of data lines DL1, DL2, . . . , DLm. That is, each demultiplexer 151 may selectively couple the data lines coupled to each coupled output line according to a demultiplexing signal CL. The demultiplexing signal CL may be included in the third driving control signal CONT3 output from the control unit 120. The third driving control signal CONT3 may include signals controlling starting, ending, and operating of the data distributing unit 150. Here, one demultiplexer 151 may selectively couple two data lines and one output line which are continuously arranged (i.e., electrically coupled to each other). That is, one demultiplexer 151 may selectively couple the first output line OL1 and one of the first data line DL1 and the second data line DL2. In addition, the demultiplexer 151 adjacent with the demultiplexer 151 may selectively couple a second output line OL2 and one of a third data line DL3 and a fourth data line DL4. Here, a first data signal D1 and a second data signal D2 may be provided to the first output line OL1 as a combined signal and may be demultiplexed in the demultiplexer 151 to be sequentially applied to the first data line DL1 and the second data line DL2. Further, a third data signal D3 and a fourth data signal D4 may be provide to the second output line OL2 as a combined signal and may demultiplexed in the demultiplexer 151 to be sequentially applied to the third data line DL3 and the fourth data line DL4. Hereinafter, it is described that the demultiplexer 151 switches two data lines, but is just an example, and the number of data lines which may be coupled with the demultiplexer 151 and the structure of the demultiplexer 151 are not limited to those illustrated in FIGS. 1 and 2.

FIG. 2 is a block diagram schematically illustrating a configuration of the demultiplexer 151 coupled to the first data line DL1 and the second data line DL2. The following description may be substantially equally applied even to another demultiplexer 151 of the data distributing unit 150. The demultiplexer 151 may include a first switch Sw1 controlling connection of the first data line DL1 and the first output line OL1 and a second switch Sw2 controlling the second data line DL2 and the first output line OL1. The demultiplexer 151 may selectively provide the data signal provided through the first output line OL1 to the first data line DL1 and the second data line DL2. The first switch Sw1 may be activated by a first demultiplexing signal CL1 and couple the first data line DL1 and the first output line OL1. The second switch Sw2 may be activated by a second demultiplexing signal CL2 and couple the second data line DL2 and the first output line OL1. The first demultiplexing signal CL1 and the second demultiplexing signal CL2 may be sequentially output for a gate-on period of the scan signal. That is, for the gate-on period of the scan signal, the demultiplexer 151 may switch the first data line DL1 and the second data line DL2 and output the first data signal D1 to the first data line DL1 and output the second data signal D2 to the second data line DL2.

Here, the data distributing unit 150 is illustrated as a separate block from the data driver 130, but the data distributing unit 150 and the data driver 130 may be mounted on a substrate formed with the display unit 110 as one circuit. The organic light emitting display 10 according to the embodiment includes the data distributing unit 150 configured as the plurality of demultiplexers 151 and thus the number and the configuration of the data drivers 130 may be more simply designed.

The plurality of pixels PXs receives the scan signal from the scan driver 140 as a pixel row unit and may emit light with a brightness corresponding to the data signal applied through the data distributing unit 150.

Here, as illustrated in FIG. 3, the plurality of pixels PXs may be defined as a plurality of pixel row groups G1, G2, . . . , Gk. The plurality of pixel row groups G1, G2, . . . , Gk may include the same number of pixel rows. The plurality of pixel row groups G1, G2, . . . , Gk may be continuously defined (e.g., arranged adjacent to each other). Here, a first pixel row group G1 may include a pixel row coupled to the first scan line SL1 and a p-th scan line SLp), and the second pixel row group G2 may include a pixel row coupled to a p+1-th scan line SLp+1 and a 2p-th scan line SL2*p* (however, p is a natural number of 2 or more). In one embodiment, for example, p may be 8. That is, the first pixel row group G1 may include the first pixel row coupled to the first scan line SL1 to the p-th pixel row coupled to the p-th scan line SLp. Here, the organic light emitting display 10 according to the embodiment may be driven based on the plurality of pixel row groups G1, G2, . . . , Gk. For example, each pixel row sequentially receives and stores the data signals, performs initialization for each pixel group and compensation of the threshold voltage, and then transfers the data signals to emit the light.

Hereinafter, an operation of the organic light emitting display 10 according to the embodiment will be described in more detail with reference to FIGS. 4 to 10.

Figure 4:
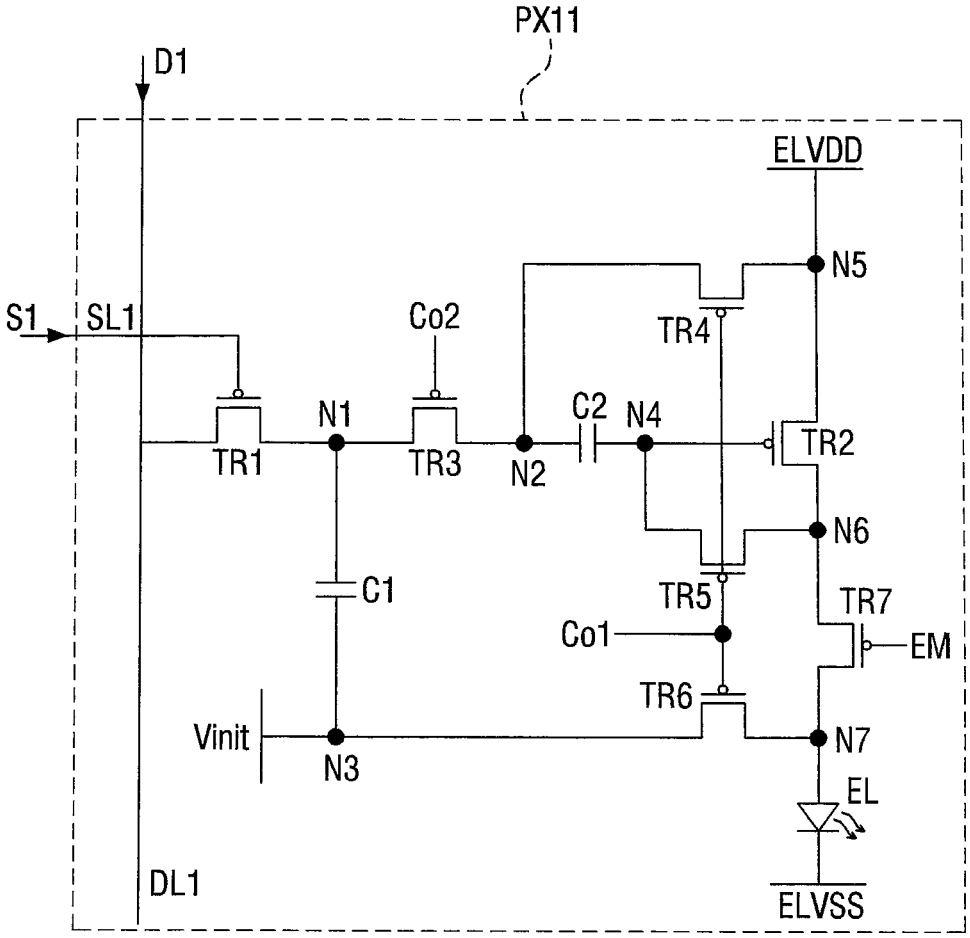
FIG. 4 is a circuit diagram illustrating one pixel of the organic light emitting display according to the embodiment of the present invention.
Figure 5:
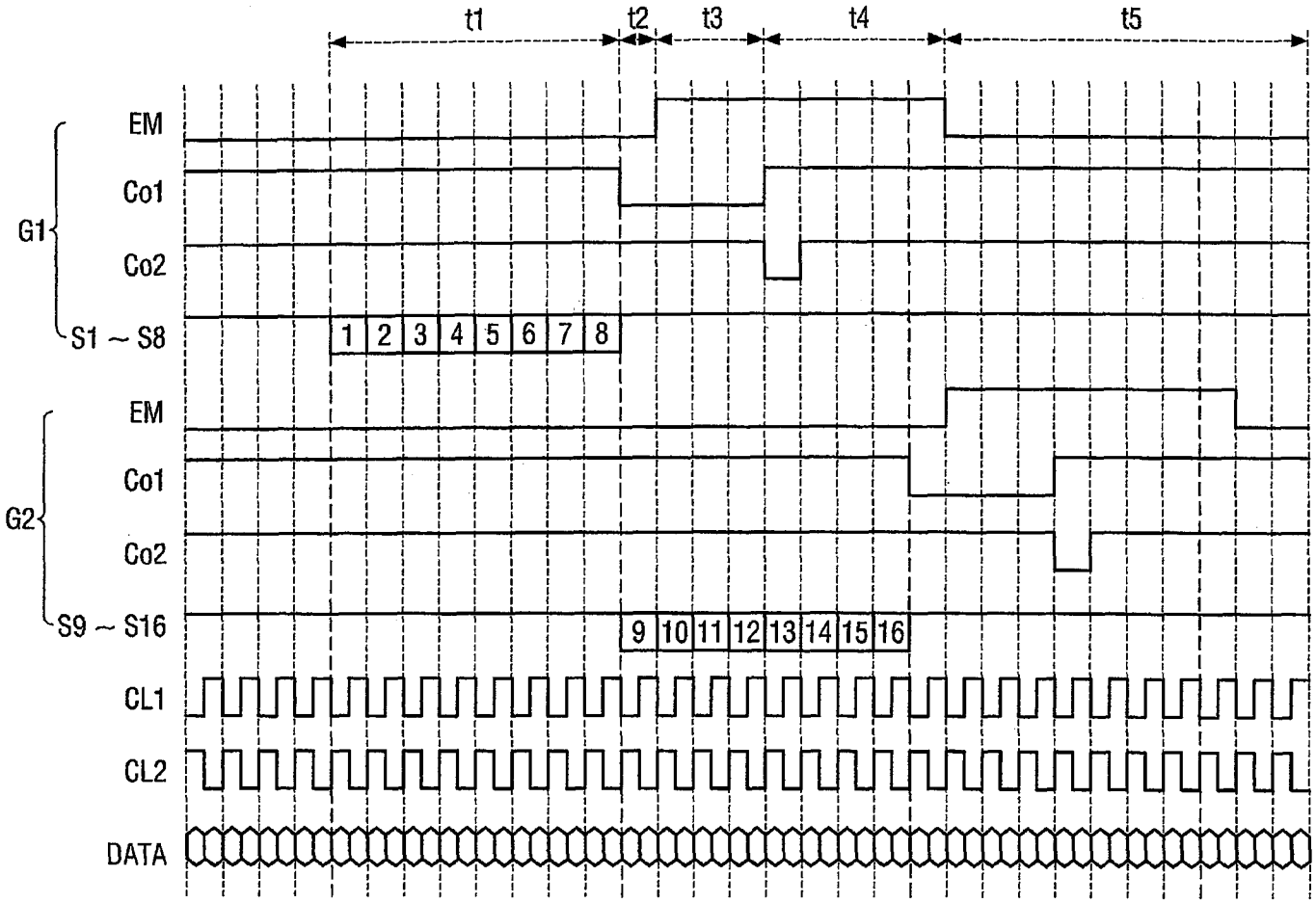
FIG. 5 is a timing diagram of the organic light emitting display according to the embodiment of the present invention.
Figure 6:
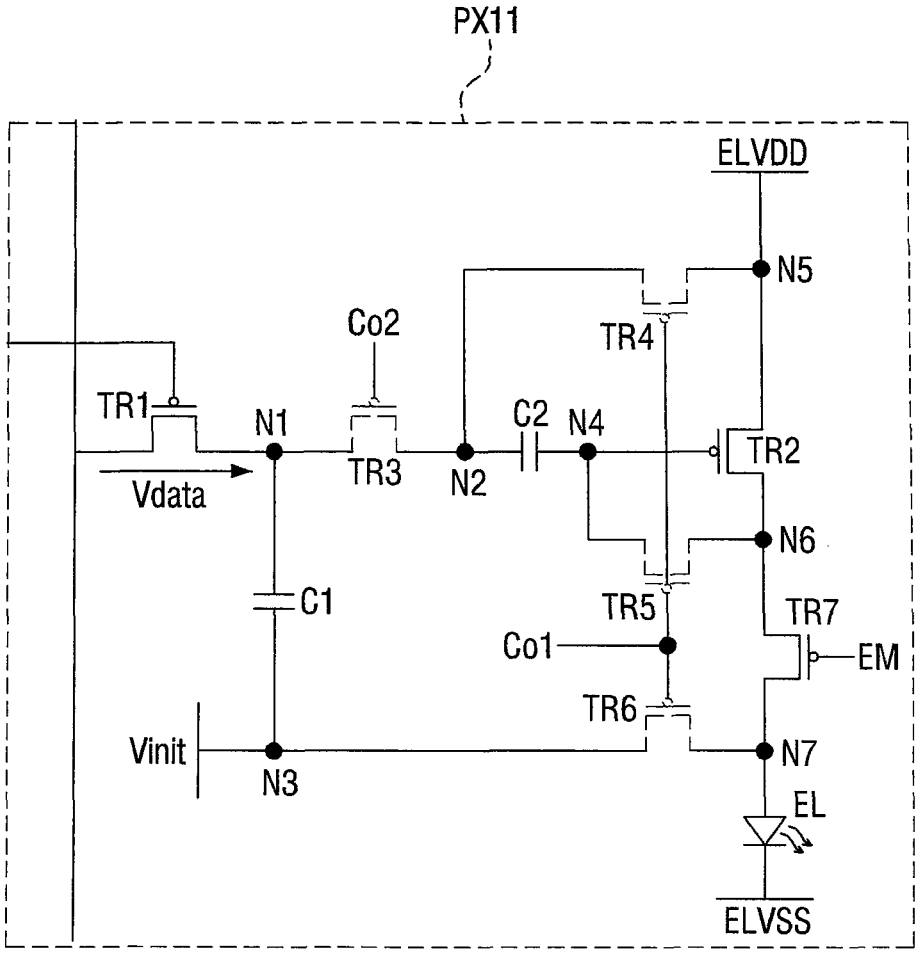
FIGS. 6 to 10 are circuit diagrams illustrating an operation of one pixel for each period of the organic light emitting display according to the embodiment of the present invention.
Figure 7:
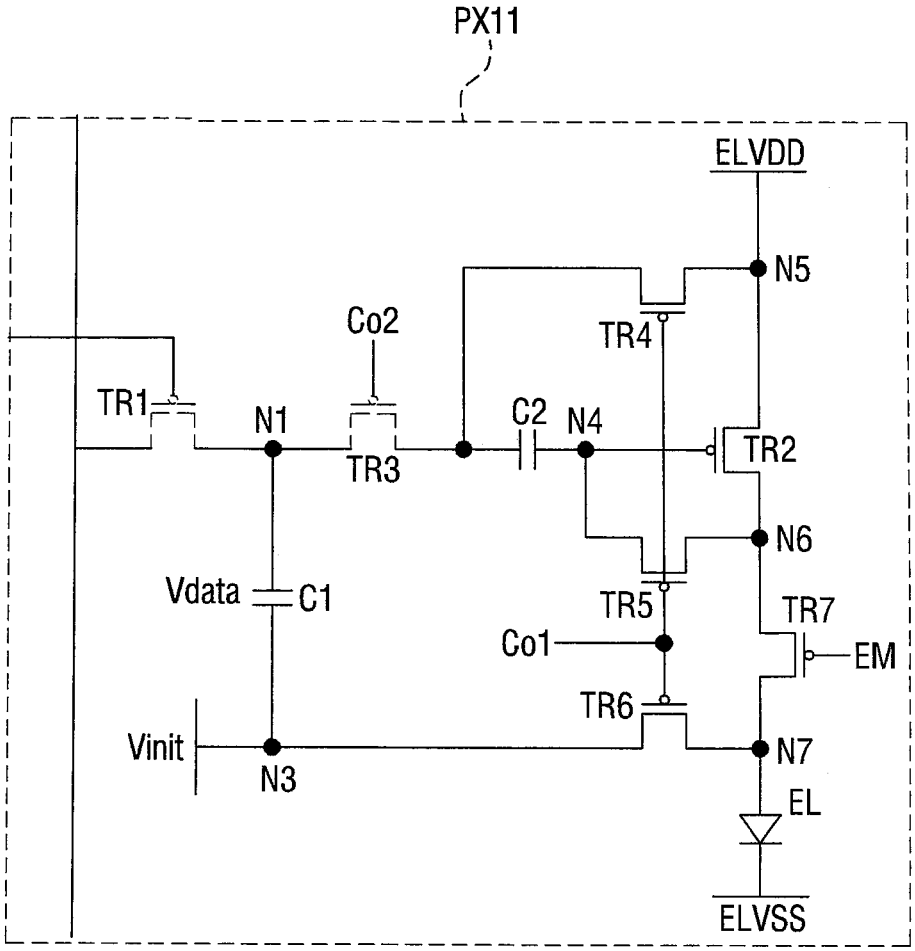
Figure 8:
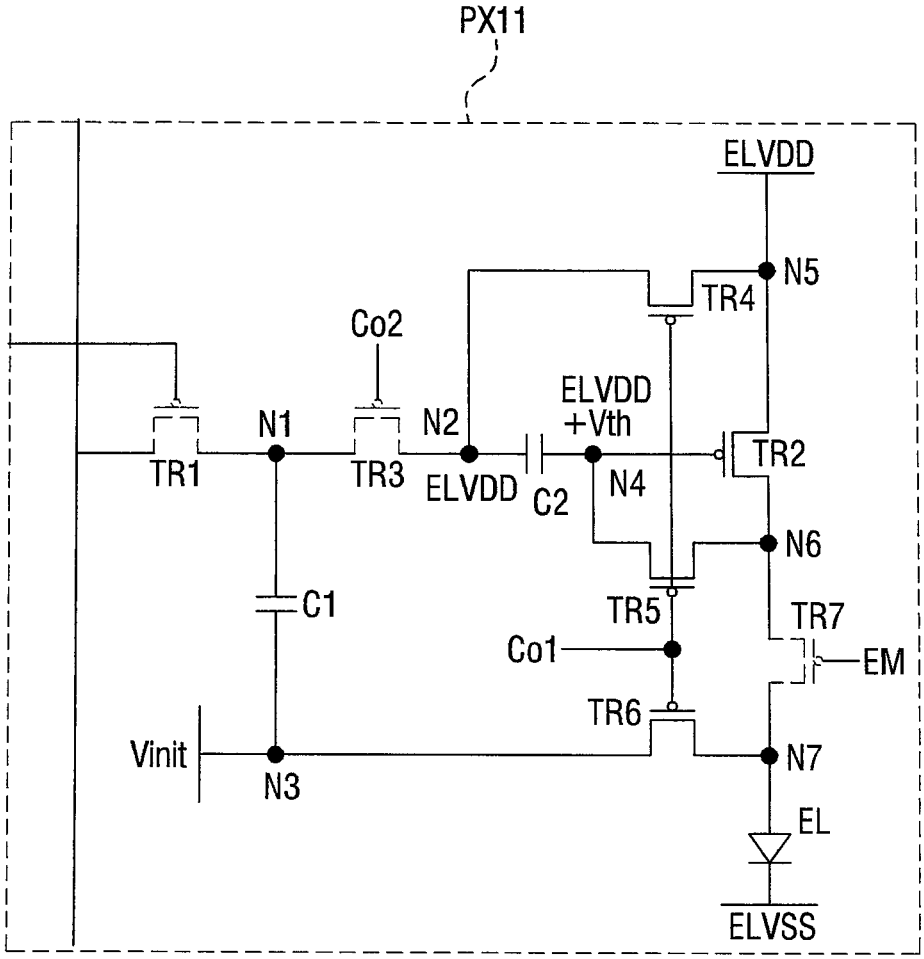
Figure 9:
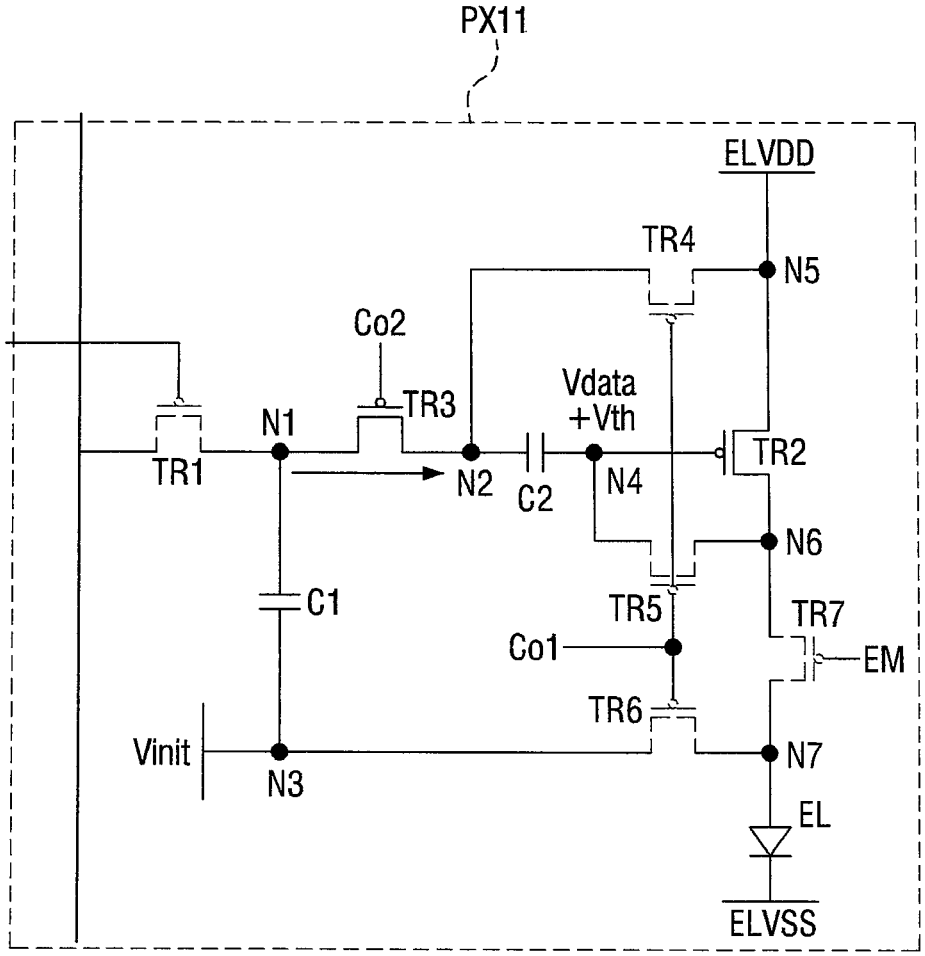
Figure 10:
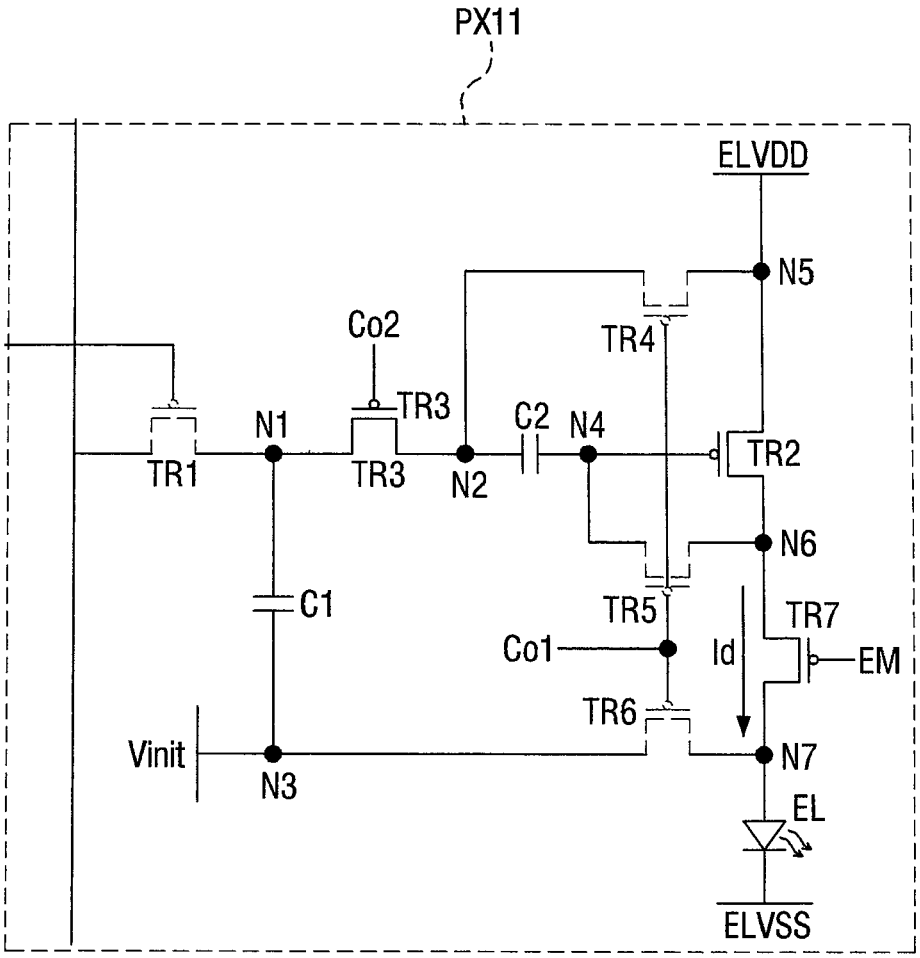

FIG. 4 is a circuit diagram illustrating one pixel of the organic light emitting display according to some embodiments of the present invention, FIG. 5 is a timing diagram of the organic light emitting display according to some embodiments of the present invention, and FIGS. 6 to 10 are circuit diagrams illustrating an operation of one pixel for each period of the organic light emitting display according to some embodiments of the present invention.

Here, FIG, 4 illustrates a circuit of one pixel PX11 defined by the first scan line SL1 and the first data line DL1, and other pixels may also have the same structure. However, the circuit structure of FIG. 4 is an example circuit structure and the circuit of the pixel according to the embodiment is not limited thereto.

Referring to FIGS. 4 to 10, each pixel PX of the organic light emitting display according to some embodiments may include an organic light emitting element EL, first to seventh transistors TR1 to TR7, a first capacitor C1, and a second capacitor C2. That is, each pixel PX may have a 7T2C structure.

The first transistor TR1 may include a gate electrode coupled to the first scan line SL1, one electrode coupled with the first data line DL1, and the other electrode coupled to a first node N1. The first transistor TR1 is turned on by a scan signal S1 of a gate-on voltage applied to the scan line SL1 to transfer a data signal D1 applied to the data line DL1 to the first node N1. The first transistor TR1 may be a switching transistor which selectively provides a data signal Dj to a driving transistor. Here, the first transistor TR1 may be a p-channel field effect transistor. That is, the first transistor TR1 may be turned on by the scan signal at a low-level voltage and turned off by the scan signal at a high-level voltage. Here, the second to seventh transistors TR2 to TR7 may be p-channel field effect transistors. However, it is not limited thereto and in some embodiments, the first to seventh transistors TR1 to TR7 may be configured as n-channel field effect transistors. One electrode of the first capacitor C1 and one electrode of the third transistor TR3 may be coupled to the first node N1. Here, the other electrode of the first capacitor C1 may be coupled with a third node N3 to which an initialization voltage Vinit is applied. The first capacitor C1 may be coupled between the first node N1 and the third node N3. The data signal may be charged in the first capacitor C1 through the first transistor TR1.

The second transistor TR2 may be a driving transistor. The second transistor TR2 may control a driving current Id supplied to the organic light emitting element EL from the first power voltage ELVDD according to a voltage level of the gate electrode. The second transistor TR2 may include a gate electrode coupled with a fourth node N4, the other electrode coupled with a fifth node N5, and one electrode coupled with a sixth node N6. Here, the other electrode of the second capacitor C2 may be coupled to the fourth node N4, and the first power voltage ELVDD and the other electrode of the fourth transistor TR4 may be coupled to the fifth node N5.

In the third transistor TR3, a gate electrode may be coupled with the second control line and the third transistor TR3 may be turned on by a second control signal Co2. In the third transistor TR3, one electrode may be coupled to the first node N1 and the other electrode may be coupled to the second node N2. Here, one electrode of the second capacitor C2 and one electrode of the fourth transistor TR4 may be coupled to the second node N2. That is, the second capacitor C2 may be coupled between the second node N2 and the fourth node N4. The second capacitor C2 may be a capacitor in which the threshold voltage Vth is charged in a compensation step of the threshold voltage to be described below.

Gate electrodes of the fourth transistor TR4, the fifth transistor TR5, and the sixth transistor TR6 may be all coupled with the first control line. That is, the fourth transistor TR4, the fifth transistor TR5, and the sixth transistor TR6 may be turned on by the first control signal Co1. The fourth transistor TR4 may couple the fifth node N5 to which the first power voltage ELVDD is applied and the second node N2 to which one electrode of the second capacitor is coupled according to the first control signal Co1. In addition, the fifth transistor TR5 may couple the fourth node N4 and the sixth node N6 according to the first control signal Co1. That is, the fifth transistor TR5 may diode-couple the second transistor TR2 which is a driving transistor according to the first control signal Co1. In the sixth transistor TR6, one electrode may be coupled to the third node N3 and the other electrode may be coupled to the seventh node N7. An anode of the organic light emitting element EL may be coupled to the seventh node N7.

The seventh transistor TR7 may initialize a voltage charged in the anode according to the first control signal Co1 and the gate electrode of the driving transistor TR2 at the initialization voltage Vinit.

The seventh transistor TR7 may block a flow of the driving current Id. That is, in the seventh transistor TR7, the gate electrode may be coupled with the light emission control line, one electrode may be coupled with the sixth node N6, and the other electrode may be coupled with the seventh node N7. The seventh transistor TR7 may be a light emission control transistor and block the driving current Id flowing into the organic light emitting element EL by a light emission control signal EM.

The organic light emitting element EL may include an anode coupled to the seventh node N7, a cathode coupled to the second power voltage ELVSS, and an organic light emitting layer. The organic light emitting layer may display one light of the primary colors. Here, the primary colors may be three primary colors of red, green, and blue. A desired color may be displayed by a spatial sum or a temporal sum of the three primary colors. The organic light emitting layer may include a low molecular organic material or a high molecular organic material corresponding to each color. The organic material corresponding to each color may emit light according to a current amount flowing in the organic light emitting layer to radiate the light.

The first pixel row group G1 and the second pixel row group G2 may be operated as the timing diagram illustrated in FIG. 5. Here, the first pixel row group G1 may include a plurality of pixel rows coupled to the first to eight scan lines SL1 to SL8, respectively, and the second pixel row group G2 may include a plurality of pixel rows coupled to the ninth to sixteenth scan lines SL9 to SL16, respectively. The first pixel row group G1 and the second pixel row group G2 may sequentially operate. That is, the first to eight scan signals SL1 to SL8 are sequentially provided to the first pixel row group G1 and the data signals may be input, and thereafter, the ninth to sixteenth scan signals SL9 to SL16 are sequentially provided to the second pixel row group G2 and the data signals may be input. Hereinafter, the operating process of the organic light emitting display according to the embodiment is described based on the operation of the first pixel row group G1, but may be equally applied to other pixel row groups.

An operation period of the first pixel row group G1 may be divided into a first period t1 to a fifth period t5. Here, the first period t1 may be a period for which the data signal is input, the second period t2 may be an initialization period, the third period T3 may be a period for compensating for the threshold voltage, the fourth period t4 may be a period for transferring the data signal, and the fifth period t5 may be a light emitting period. Hereinafter, for ease of description, it is assumed that the voltage provided to each data line corresponding to the data signal is set as the data voltage Vdata and the first pixel row group G1 is configured by the first to eighth pixel rows. Herein, FIGS. 6 to 10 schematically illustrates the operation of each pixel for the first period t1 to the fifth period t5, and here, may illustrate a state in which a transistor which is represented by a solid line is turned on and a transistor which is represented by a dotted line is turned off.

For the first period t1, the first to eighth scan signals S1 to S8 may be sequentially provided. That is, the pixel rows included in the first pixel row group G1 are sequentially turned on to receive the data voltage Vdata. In this case, the data voltage Vdata may be demultiplexed to be distributed to each data line. That is, the data voltage Vdata may be temporally divided according to the demultiplexing signal to be applied to different data lines.

For a period while a low-level gate-on voltage is applied in the first scan signal S1, the first demultiplexing signal CL1 and the second demultiplexing signal CL2 may be sequentially output. The first demultiplexing signal CL1 and the second demultiplexing signal CL2 may be provided to each multiplexer 151 included in the data distributing unit 150 and each multiplexer 151 may couple each output line and the data line in response to the signal. That is, the first switch SW1 in FIG. 2 described above corresponding to the low-level voltage of the first demultiplexing signal CL1 may couple the first output line OL1 and the first data line DL1 to transfer the data signal, and the second switch SW2 in FIG. 2 described above corresponding to the low-level voltage of the second demultiplexing signal CL2 may couple the first output line OL1 and the second data line DL2 to transfer the data signal. The second scan signal S2 may be sequentially output with the first scan signal S1, and the first demultiplexing signal CL1 and the second demultiplexing signal CL2 corresponding to the second scan signal S2 may be output. That is, the demultiplexing signals may be sequentially output to correspond to the scan signals which are sequentially provided.

The first transistor TR1 of each pixel may be turned on by the scan signal and supply the data voltage Vdata to the first node N1. Here, because the third transistor TR3 is in a tuned-off state, the data voltage Vdata provided to the first node N1 may be charged in the first capacitor C1. In this case, the organic light emitting element EL may be in a light emitting state. That is, the light emission control signal EM is provided at the low level and thus the seventh transistor TR7 may be in the turned-on state. That is, the first period t1 may be a period for which the organic light emitting element EL emits light by the data voltage Vdata provided in a pervious frame and the data voltage Vdata in a current frame is charged in the first capacitor C1.

For the second period t2, the gate voltage of the second transistor TR2, which is the driving transistor, is initialized by applying the initialization voltage. That is, for the second period t2, the first control signal Co1 may be provided at the low level and turn on the fourth, fifth, and sixth transistors TR4, TR5, and TR6. The light emission control signal EM may be continuously provided at the low level, and the seventh transistor TR7 may be continuously in the turned-on state. As a result, a gate terminal of the second transistor TR2 and an end coupled with the organic light emitting element EL may be initialized at the initialization voltage Vinit. The initialization may be simultaneously performed in all the pixels included in the first pixel group G1. That is, the initializing operation is not sequentially performed for each pixel row, but the initializing operation may be simultaneously performed in all the pixels included in each group.

For the third period t3, the fourth, fifth, and sixth transistors TR4, TR5, and TR6 may be continuously in the turned-on state. In addition, the light emission control signal EM may be changed to a high level. Accordingly, the seventh transistor TR7 may be turned off and the compensation of the threshold voltage Vth may be performed. The change of the light emission control signal EM may be concurrently (e.g., simultaneously) performed in all the pixels included in the first pixel group G1.

That is, the compensation of the threshold voltage Vth may also be concurrently (e.g., simultaneously) performed in all the pixels included in each pixel group. Here, a voltage corresponding to the ELVDD and a voltage corresponding to ELVDD+Vth may be input to the second node N2 and the fourth node N4 which are both terminals of the second capacitor C2. As the seventh transistor TR7 is turned off, the current may flow from the fifth node N5 in which a potential difference is generated to the fourth node N4 through the second transistor TR2. In this case, when a potential difference between a gate terminal and a source terminal of the second transistor TR2 is the threshold voltage Vth or less, the second transistor TR2 may be turned off. That is, until the voltage level of the third node N3 becomes ELVDD+Vth, the voltage of the fifth node N5 may be discharged through the second transistor TR2 which is the driving transistor. Here, as the voltage level of the second node N2 is formed as the ELVDD and the voltage level of the fourth node N4 is formed as the ELVDD+Vth, Vth may be charged in the second capacitor C2.

For the fourth period t4, the first control signal Co1 may be changed to the high level and as a result, the fourth, fifth, and sixth transistors TR4, TR5, and TR6 may be turned off. In addition, the fourth period t4 may include a period for which the second control signal Co2 is provided at the low level. That is, for the fourth period t4, the second control signal Co2 may be provided at the low level for a predetermined time. As the second control signal Co2 is provided at the low level, the third transistor TR3 may be turned on. Accordingly, the data voltage Vdata which is charged in the first capacitor C1 may be provided to the second node N2. The voltage level of the second node N2 may be changed to the voltage level corresponding to the data voltage Vdata. In addition, the second capacitor C2 may couple the voltage of the fourth node N4 in proportion to a change in voltage of the second node N2, according to a change in voltage of the second node N2. That is, the voltage of the fourth node N4 may become the Vdata+Vth. That is, the fourth period T4 may be a period for which the voltage of the fourth node N4 is changed by transferring the data voltage Vdata charged in the first capacitor C1 to the second node N2 and coupling the data voltage. For the fourth period T4, the data voltage Vdata may be concurrently (e.g., simultaneously) transferred to the pixels in each pixel group.

The fifth period t5 may be a light emitting period. That is, the light emission control signal EM may be changed to the low level, and the second transistor TR2 may supply the driving current Id to the organic light emitting element EL according to the voltage of the fourth node N4. In this case, the driving current Id supplied to the organic light emitting element EL from the driving transistor TR2 may be $(1/2)\times K(Vgs-Vth)$.

Here, K is a constant value determined by mobility and parasitic capacitance of the second transistor TR2. In addition, Vg may be the Vdata+Vth which is the voltage of the fourth node N4, Vs may be the ELVDD which is the voltage of the fifth node N5, and Vgs may be Vg-Vs. That is, the driving current may have an amplitude corresponding to the data voltage Vdata in a state where an effect of the threshold voltage Vth is excluded. That is, the organic light emitting display according to the embodiment compensates for a characteristic deviation of the second transistor TR2 to reduce the luminance deviation between the pixels PXs. As such, for the fifth period t5, the change of the light emission control signal EM may be concurrently (e.g., simultaneously) performed in the pixels in each pixel group, and the pixels in each pixel group may concurrently (e.g., simultaneously) emit the light.

The organic light emitting display according to some embodiments concurrently (e.g., simultaneously) performs the initialization for each pixel row block and the compensation of the threshold voltage to save the time required for the initialization and the threshold voltage. That is, a sufficient time for applying the scan signal may be ensured. Further, the organic light emitting display according to some embodiments may charge the data voltage in the current frame by overlapping with the period in which the organic light emitting element emits the light at the data voltage in the previous frame to sufficiently ensure a scan time required to demultiplex the data voltage. Accordingly, even though one horizontal time is reduced by increasing the resolution, the application time of the scan signal and the compensation time of the threshold voltage may be sufficiently provided. Furthermore, the organic light emitting display according to some embodiments is driven for each pixel row block, but the scan signals may be sequentially provided to each line. That is, the scan signals are not concurrently (e.g., simultaneously) provided to one scan line and the other scan line, and as a result, the coupling between the scan signals may not occur. Further, the compensation of the threshold voltage is not a method of applying a reference voltage having a defined or predetermined level to prevent or reduce abnormal voltage swing of the reference voltage-data voltage which may occur by applying the reference voltage. That is, more improved display quality may be provided.

Hereinafter, an organic light emitting display according to another embodiment of the present invention will be described.

Figure 11:
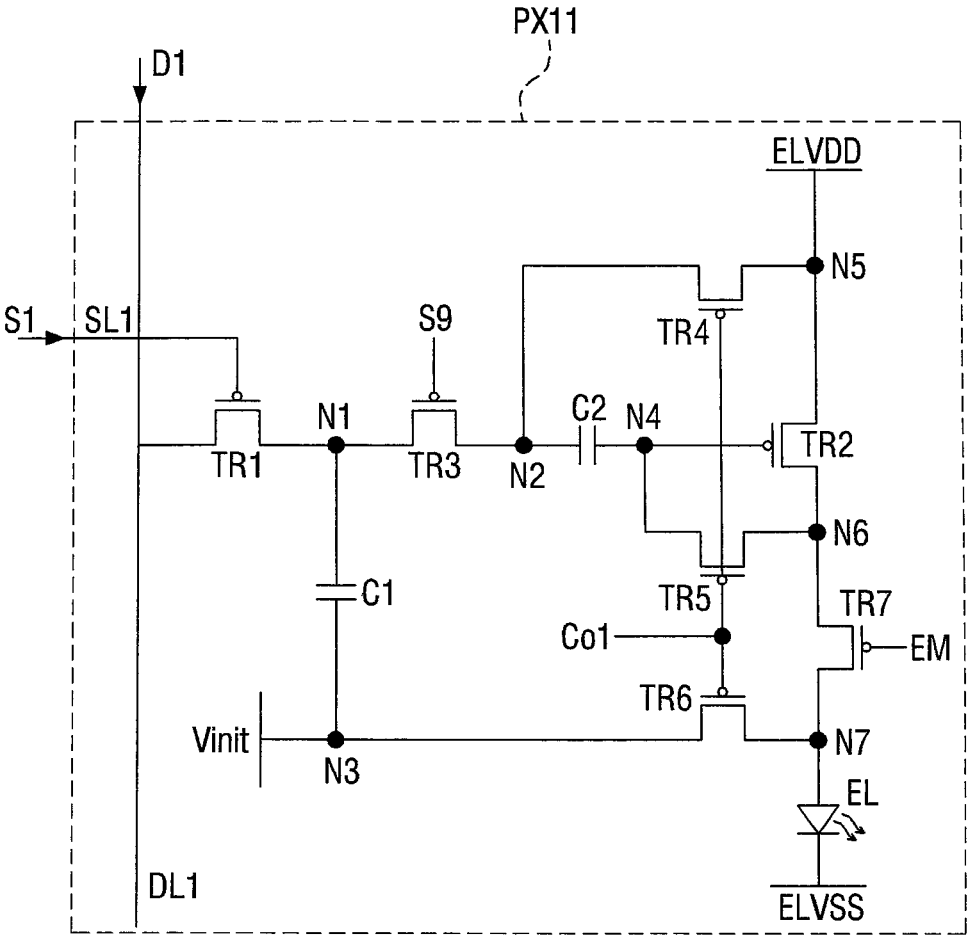
FIG. 11 is a circuit diagram of one pixel of an organic light emitting display according to another embodiment of the present invention.
Figure 12:
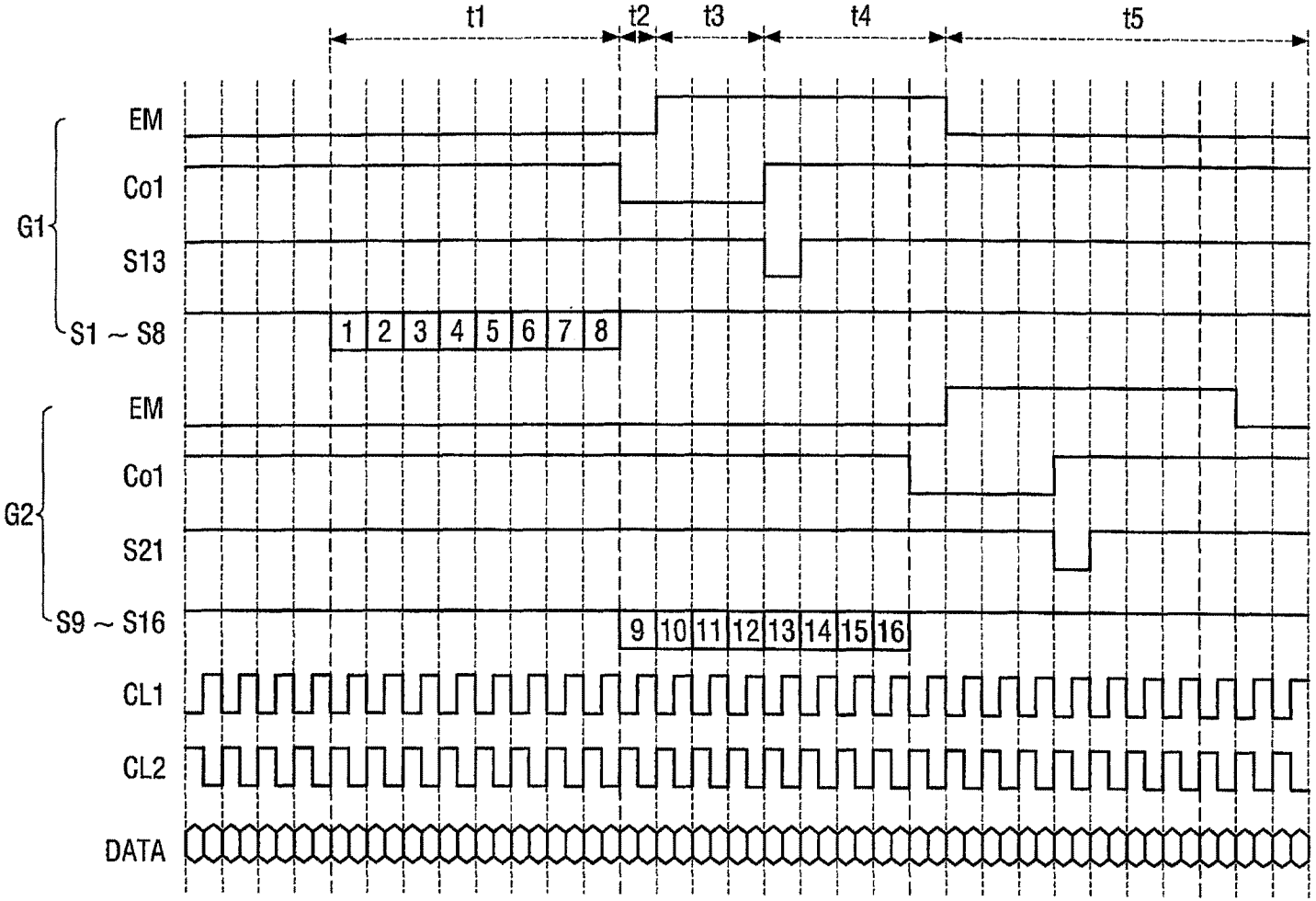
FIG. 12 is a timing diagram of the organic light emitting display according to another embodiment of the present invention.

FIG. 11 is a circuit diagram of one pixel of an organic light emitting display according to another embodiment of the present invention, and FIG. 12 is a timing diagram of the organic light emitting display according to another embodiment of the present invention.

FIG. 11 illustrates a circuit of one pixel PX11 defined by the first scan line SL1 and the first data line DL1, and other pixels may also have the same structure. However, the circuit structure of FIG. 11 is an example, and the circuit of the pixel according to some embodiments is not limited thereto.

Referring to FIGS. 11 and 12, in the organic light emitting display according to another embodiment of the present invention, a third transistor TR3 of each pixel included in one pixel row group may be coupled to any one scan line provided to (e.g., coupled to) another pixel row group in which gate electrodes are continuous. The third transistor TR3 of each pixel included in a first pixel row group G1 may be turned on by any scan signal provided to a subsequent second pixel row group G2. For example, when the first pixel row group G1 includes a first scan line SL1 to an eighth scan line SL8 and the second pixel row group G2 includes a ninth scan line SL9 to a seventeenth scan line SL17, the third transistors TR3 of the pixels included in the first pixel row group G1 may be coupled to a thirteenth scan line SL13 and the gate electrode. The third transistors TR3 of the pixels included in the first pixel row group G1 may be turned on by a thirteenth scan signal S13 supplied to the thirteenth scan line SL13. That is, the thirteenth scan signal S13 may turn on the third transistors TR3 of the pixels included in the first pixel row group G1 as well as the first transistors TR1 of the pixels coupled with the thirteenth scan line SL13. That is, the organic light emitting display according to another embodiment of the present invention may control the third transistor TR3 of each pixel included in one pixel row group by the scan signals provided to one pixel row group and another subsequent pixel row group together. That is, a circuit for outputting the control signal required to control the third transistors TR3 may not be additionally formed.

Other descriptions for the organic light emitting display are substantially the same as the descriptions having the same name included in the organic light emitting display of FIGS. 1 to 10 to be omitted.

Hereinafter, a driving method of an organic light emitting display according to yet another embodiment of the present invention will be described.

Figure 13:
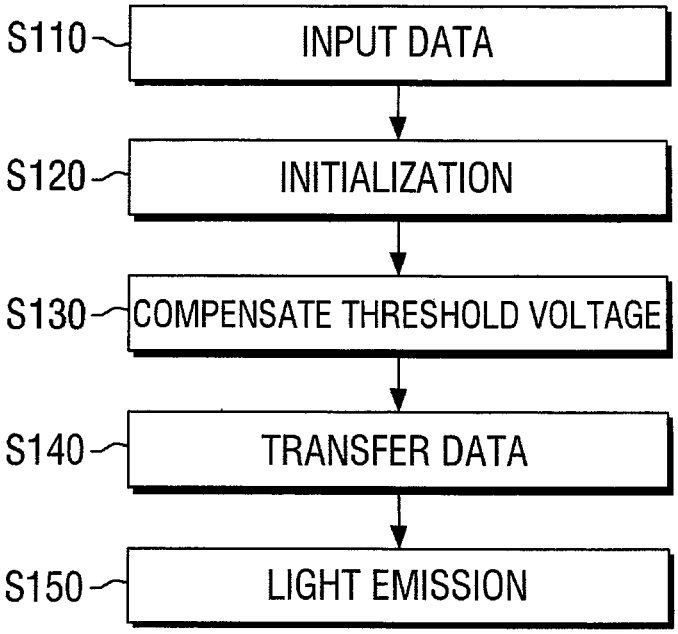
FIG. 13 is a flowchart of a driving method of an organic light emitting display according to yet another embodiment of the present invention.

FIG. 13 is a flowchart of a driving method of an organic light emitting display according to yet another embodiment of the present invention. FIGS. 1 to 12 may be referred to for easy description of the embodiment.

The driving method of the organic light emitting display according to some embodiments of the present invention includes a data signal inputting step (S110), an initialization step (S120), a threshold voltage compensating step (S130), a data transferring step (S140), and an emission step (S150). The driving method of the organic light emitting display according to some embodiments of the present invention may define a plurality of pixels PX arranged in matrix as a plurality of pixel row groups G1, G2, Gk including pixel rows of the same number and individually drive the pixels for each pixel row group. Herein, each pixel may include an organic light emitting element EL and a driving transistor TR2 driving the organic light emitting element EL.

That is, the driving method of the organic light emitting display according to the embodiment of the present invention may individually drive each pixel for each pixel row group. Further, each pixel row group may be sequentially driven. That is, the second pixel row group G2 arranged continuously with (e.g., directly adjacent to) the first pixel row group G1 may sequentially receive a data signal from the first pixel row group G1. For example, the second pixel row group G2 may receive the data signal while the first pixel row group G1 performs the initialization step and the threshold voltage compensating step. Hereinafter, the driving method of the organic light emitting display according to the embodiment of the present invention will be described based on the first pixel row group G1.

First, the data signal is input (S110).

The data signal is generated by a data driver 130 to be transferred to a data distributing unit 150. The data distributing unit 150 may include a plurality of demultiplexers 151. Each demultiplexer 151 may be coupled with at least two data lines which are continuously arranged (e.g., continuous and electrically coupled) among a plurality of data lines DL1, DL2, DLm. The plurality of data lines may be coupled with pixels included in one pixel row, respectively. That is, the data signal may be provided to the data distributing unit 150 while signals provided to the respective data lines are combined and the data signal is demultiplexed by the demultiplexer 151 to be distributed to each data line. Herein, the first pixel row group G1 may include first to eighth scan lines SL1 to SL8. That is, first to eighth scan signals S1 to S8 may be sequentially provided to the first pixel row group G1. The demultiplexed signal may be output during a gate-on period of each scan signal and the data signal multiplexed and provided to the data line may be input in each pixel. In this case, the pixels included in each pixel row group may include a first capacitor charged with the data signal and a control transistor TR3 controlling connection of the first capacitor C1 and a gate terminal of a driving transistor TR2. Herein, the control transistor TR3 may be turned off and the provided data signal may be charged in the first capacitor C1. Herein, the data signal may be input while the organic light emitting element EL emits light by a data signal of a previous frame. That is, although the data signal which is demultiplexed is input, a sufficient scan time may be secured.

Subsequently, initialization voltage Vinit is applied (S120).

An initialization voltage Vinit may be provided to pixels included in the first pixel row group G1. That is, voltage levels of the gate terminal of the driving transistor TR2 and an anode terminal of the organic light emitting element EL may be initialized to the initialization voltage. A component that provides the initialization voltage may be the component illustrated in FIG. 4, but is not limited thereto. The initialization voltage Vinit may be provided to the pixels included in the first pixel row group G1. The initialization step (S120) may be simultaneously performed in the pixels included in the first pixel row group G1.

Subsequently, a threshold voltage Vth is compensated (S130).

The threshold voltage Vth of the driving transistor TR2 may be simultaneously compensated in the pixels included in the first pixel row group C1. Herein, the organic light emitting display according to the embodiment may further include a second capacitor C2 coupled between the control transistor TR3 and the gate terminal of the driving transistor TR2. Herein, the compensation of the threshold voltage Vth may be a period in which a voltage corresponding to the threshold voltage Vth is charged in the second capacitor C2: Herein, the threshold voltage compensating step (S130) may be substantially the same as a third period t3, but is not limited thereto.

However, duplicated description will be omitted.

Next, the data signal is transferred (S140).

In the data signal transferring step (S140), the control transistor TR3 may be turned on. The control transistor TR3 may be turned on by a control signal provided from a separate control line. However, the present invention is not limited thereto and a gate electrode of the control transistor TR3 of the pixels included in the first pixel row group G1 may be coupled with one of scan lines coupled with the second pixel row group G2. The control transistor TR3 of each pixel included in the first pixel row group G1 may be turned on by a scan signal (e.g., a predetermined scan signal) provided to the continued second pixel row group G2. For example, when the first pixel row group G1 includes a first scan line SL1 to an eighth scan line SL8 and the second pixel row group G2 includes a ninth scan line SL9 to a seventeenth scan line SL17, the control transistor TR3 of the pixels included in the first pixel row group G1 may be coupled with a gate electrode of the thirteenth scan line SL13. When voltage corresponding to the data signal charged in the first capacitor C1 is referred to as data voltage Vdata, voltage at one terminal of the second capacitor C2 may be Vdata. As the voltage at one terminal of the second capacitor C2 varies, voltage of the other terminal may be proportionally coupled with the voltage at one terminal. That is, voltage at the gate terminal of the driving transistor TR2 which is the other terminal of the second capacitor C2 may be Vdata+Vth.

Next, the organic light emitting element emits light (S150).

In the current step, the driving transistor TR2 and the organic light emitting element EL may be electrically coupled with each other and the driving transistor TR2 may supply a driving current Id to the organic light emitting element EL depending on the voltage at the gate terminal. While an influence by the threshold voltage Vth of the driving transistor TR2 is excluded, a luminance deviation among the respective pixels PX may be minimized.

Besides, because another description of the driving method of the organic light emitting display is substantially the same as descriptions having the same name, which are included in the organic light emitting display of FIGS. 1 to 12, some repetitive description will be omitted.

In the driving method of the organic light emitting display according to some embodiments, because the initialization and the compensation of the threshold voltage are concurrently (e.g., simultaneously) performed for each pixel row block, a time required for the initialization and the threshold voltage may be saved. That is, a sufficient time for applying the scan signal may be secured. Further, in the driving method of the organic light emitting display according to some embodiments, because the data voltage of the current frame may be charged with a data voltage of the previous frame by overlapping with a period in which the organic light emitting element emits light, a scan time required to demultiplex the data voltage may be sufficiently secured. Accordingly, although one horizontal time decreases due to an increase in resolution, the application time of the scan signal and the compensation time of the threshold voltage may be sufficiently provided. Furthermore, in the driving method of the organic light emitting display according to the embodiment, although the pixels are driven for each pixel row block, the scan signal may be sequentially provided to each line and the data signal may also be sequentially input according to the pixel row. That is, because the scan signal is not provided to one scan line concurrently (e.g., simultaneously) with another scan line, the scan lines may not be coupled. Further, because there is no scheme in which a reference voltage (e.g., at a predetermined level) is applied in the case of compensating the threshold voltage, abnormal voltage swing of the reference voltage and the data voltage, which may occur with application of the reference voltage, may be prevented or reduced. That is, more enhanced display quality may be provided.

The foregoing is illustrative of the present invention and is not to be construed as limiting thereof. Although a few embodiments of the present invention have been described, those skilled in the art will readily appreciate that many modifications are possible in the embodiments without materially departing from the novel teachings and aspects of the present invention. Accordingly, all such modifications are intended to be included within the scope of the present invention as defined in the claims, and their equivalents. Therefore, it is to be understood that the foregoing is illustrative of example embodiments of the present invention and is not to be construed as limited to the specific embodiments disclosed, and that modifications to the disclosed embodiments, as well as other embodiments, are intended to be included within the scope of the appended claims, and their equivalents. The present invention is defined by the following claims, with equivalents of the claims to be included therein.

What is claimed is:

1. An organic light emitting display comprising:

a plurality of pixels arranged in a matrix, wherein each of the pixels comprises:

an organic light emitting element;

a first transistor comprising a gate electrode coupled to a scan line, a first electrode coupled to a data line, and a second electrode directly coupled to a first node, a second transistor configured to drive the organic light emitting element according to a data voltage provided through the first transistor;

a third transistor comprising a first electrode directly coupled to the first node and a second electrode coupled to a second node;

a first capacitor comprising a first electrode directly coupled to the first node and a second electrode coupled to a third node configured to have an initialization voltage applied;

a second capacitor comprising a first electrode coupled to a fourth node coupled to a gate electrode of the second transistor and a second electrode coupled to the second node;

a fourth transistor comprising a first electrode coupled to the second node and a second electrode coupled to a fifth node coupled to the second electrode of the second transistor;

a fifth transistor comprising a first electrode coupled to the fourth node and a second electrode coupled to a sixth node coupled to an electrode of the second transistor;

a sixth transistor comprising a first electrode coupled to the third node and a second electrode coupled to an anode electrode of the organic light emitting element; and a seventh transistor comprising a first electrode coupled to the sixth node and a second electrode coupled to the anode electrode of the organic light emitting element.

2. The organic light emitting display of claim 1, wherein gate electrodes of the fourth transistor, the fifth transistor, and the sixth transistor are coupled to a same control signal line.

3. The organic light emitting display of claim 1, wherein gate electrodes of the fourth transistor, the fifth transistor, and the sixth transistor are coupled to different control signal lines.

4. The organic light emitting display of claim 1, wherein gate electrodes of the fourth transistor, the fifth transistor, and the sixth transistor are coupled to a first control signal line, and a gate electrode of the third transistor is coupled to a second control signal line different from the first control signal line.

5. The organic light emitting display of claim 1, wherein the plurality of pixels are arranged in a plurality of pixel row groups comprising pixel rows of a same number, and the third transistor of the pixels of a first pixel row group of the pixel row groups is coupled with a scan line coupled with a second pixel row group of the pixel row groups adjacent the first pixel row group.

6. The organic light emitting display of claim 5, wherein each of the pixel row groups comprises 8 pixel rows, and the gate electrode of the third transistor of pixels included in a pixel row group of the pixel row groups including k to k+7-th scan lines is coupled with a k+12-th scan line, wherein k is a natural number greater than 1.

7. The organic light emitting display of claim 5, wherein the organic light emitting display is configured to simultaneously compensate for a threshold voltage in the pixels included in the plurality of pixel row groups.

8. The organic light emitting display of claim 5, wherein the organic light emitting display is configured to sequentially apply a scan signal to the plurality of pixel row groups.

9. An organic light emitting display comprising:

a plurality of pixels arranged in matrix comprising a plurality of pixel row groups including pixel rows of a same number;

a scan driver configured to sequentially apply a scan signal to the plurality of pixels;

a data driver configured to generate a data signal provided to the plurality of pixels; and a data distributing unit configured to demultiplex the data signal and to transfer the demultiplexed data signal to the plurality of pixels, wherein the organic light emitting display is configured to simultaneously initialize the pixels included in each pixel row group and simultaneously compensate for a threshold voltage of the pixels included in each pixel row group, which are configured to charge the data signal applied before the compensation of the threshold voltage in a first capacitor, and the organic light emitting display is configured to transfer the data signal charged in the first capacitor to a gate terminal of a driving transistor after the compensation of the threshold voltage.

10. The organic light emitting display of claim 9, wherein the pixels in the each pixel row group further comprise control transistors that control coupling of the first capacitor and the gate terminal of the driving transistor.

11. The organic light emitting display of claim 10, further comprising:

a second capacitor coupled between the control transistor and the gate terminal of the driving transistor.

12. The organic light emitting display of claim 10, wherein a gate electrode of each control transistor of the pixels of a first pixel row group is coupled with a scan line coupled with a second pixel row group adjacent the first pixel row group.

13. The organic light emitting display of claim 12, wherein the each pixel row group comprises 8 pixel rows, and a gate electrode of each control transistor of pixels of a pixel row group including k to k+7-th scan lines is coupled with a k+12-th scan line, wherein k is a natural number greater than 1.

14. A driving method of an organic light emitting display, the organic light emitting display comprising a plurality of pixels arranged in a matrix comprising a plurality of pixel row groups including a plurality of pixel rows of a same number to be driven for each pixel row group and each pixel comprises an organic light emitting element and a driving transistor driving the organic light emitting element, the method comprising:

demultiplexing and inputting an image data signal in pixels of a first pixel row group;

simultaneously providing an initialization voltage to the pixels of the first pixel row group;

compensating a threshold voltage of driving transistors of the pixels of the first pixel row group;

transferring the image data signal to gate terminals of the driving transistors; and emitting an organic light emitting element in response to the image data signal, wherein each of the organic light emitting element of the pixels of the first pixel row group is configured to simultaneously initialize and simultaneously compensate for the threshold voltage, wherein a second pixel row group adjacent the first pixel row group sequentially receives the image data signal from the first pixel row group.

15. The method of claim 14, further comprising simultaneously compensating the threshold voltage of the driving transistors of the pixels included in the first pixel row group.

16. A driving method of an organic light emitting display, the organic light emitting display comprising a plurality of pixels arranged in a matrix comprising a plurality of pixel row groups including a plurality of pixel rows of a same number to be driven for each pixel row group and each pixel comprises an organic light emitting element and a driving transistor driving the organic light emitting element, the method comprising:

demultiplexing and inputting a data signal in pixels of a first pixel row group;

simultaneously providing an initialization voltage to the pixels of the first pixel row group;

sequentially providing the initialization voltage to a second pixel row group after providing the initialization voltage to the first pixel row group;

compensating a threshold voltage of driving transistors of the pixels of the first pixel row group;

transferring the data signal to gate terminals of the driving transistors; and emitting an organic light emitting element in response to the data signal, wherein each of the organic light emitting element of the pixels of the first pixel row group is configured to simultaneously initialize and simultaneously compensate for the threshold voltage, wherein the each pixel further comprises a first capacitor configured to be charged with the data signal and a control transistor controlling connection of the first capacitor and the gate terminal of the driving transistor.

17. The method of claim 16, wherein the organic light emitting display further comprises a second capacitor coupled between the control transistor and the gate terminal of the driving transistor.

18. The method of claim 16, wherein a gate electrode of each of the control transistors of pixels of the first pixel row group is coupled to a scan line coupled to a second pixel row group adjacent the first pixel row group.

19. The method of claim 16, wherein the each pixel row group comprises 8 pixel rows, and a gate electrode of control transistors of pixels included in a pixel row group including k to k+7-th scan lines is coupled to a k+12-th scan line, wherein k is a natural number greater than 1.

* * * * *